US005111751A

United States Patent [19]

Zlotek

[11] Patent Number: 5,111,751

[45] Date of Patent: May 12, 1992

[54] LINKABLE CLAMPING DEVICE FOR THE COUPLING OF TRANSPORT MEANS TO A MOBILE CABLE

[75] Inventor: Rudolf Zlotek, Mutters, Austria

[73] Assignee: Felix Wopfner KG

[21] Appl. No.: 276,473

[22] Filed: Nov. 25, 1988

[30] Foreign Application Priority Data

Nov. 25, 1987 [AT] Austria ..... 3102/87

[51] Int. Cl.[5] ..... B61B 12/12

[52] U.S. Cl. ..... 104/209; 104/211

[58] Field of Search ..... 104/206, 209, 211, 205

[56] References Cited

U.S. PATENT DOCUMENTS

| | | | |
|---|---|---|---|
| 734,435 | 7/1903 | Schuler | 104/206 |
| 781,815 | 2/1905 | Dusedau | 104/206 |
| 913,775 | 3/1909 | Seymour | 104/209 |
| 3,405,652 | 10/1968 | Meszaros | 104/204 |
| 3,662,691 | 5/1972 | Goirand | 104/204 X |
| 4,441,430 | 4/1984 | Brochand | 104/211 X |

*Primary Examiner*—Andres Kashnikow
*Assistant Examiner*—Kevin Weldon
*Attorney, Agent, or Firm*—Toren, McGeady & Associates

[57] ABSTRACT

Transport means are clamped to a movable rope (6) with a clamp capable of coupling. The clamp exhibits clamping jaws (4, 5), where one of the clamping jaws (5) can be pressed against the rope (6) based on the force of a spring (14). This clamping jaw (5) can be lifted off the rope (6) again with a spatially fixedly disposed connecting link. The movable clamping jaw (5) is formed as a two-arm lever, where the one arm of the two-arm lever forms the clamping jaw (5), and where the second arm (9) of the two-arm lever is loaded by a spring (14). An angle lever (10) is hinged at the two-arm lever (8) in such a way that the spring (14), furnishing the clamping force, is released upon opening of the clamp, as illustrated in FIG. 1.

16 Claims, 6 Drawing Sheets

FT
25
1
2
3
4
6
7
8
9
10
11
12
13
14
15
16
17
18
19
20
30
0
J

LINKABLE CLAMPING DEVICE FOR THE COUPLING OF TRANSPORT MEANS TO A MOBILE CABLE

BACKGROUND OF THE INVENTION

1. Field of the Invention

The invention relates to a clamp which can be coupled and linked for clamping of transport bodies to a movable rope, in particular for hangers of continuous rope ways with at least a pair of clamping jaws gripping the rope, where at least one clamping jaw can be pressed by at least one compression spring to the rope or, respectively, can be lifted from this rope by a tiltable lever controlled by a spatially fixed connecting link, and where the movable clamping jaw is formed as a two-armed lever, where one arm forms the clamping jaw, and where the second arm is loaded by a compression spring.

2. Brief Description of the Background of the Invention Including Prior Art

A clamp of this kind is known from the European Patent Application Laid Open EU-OS 174,701. The movable clamping jaw is part of a two-arm lever, where the one arm forms the clamping jaw, and where the second arm carries at its end a freely rotatable roller, which cooperates with a control crank, if the clamp is to be opened or, respectively, to be closed. The arm engages a compression spring close to this freely rotatable roller, which has to provide the necessary clamping pressure which, on the other hand, is tiltably supported at the clamping body. In case of a closed clamp, the axis of the compression spring, which is formed in this case as a helical spring, and the arm, at which this spring engages, form an obtuse angle with respect to each other, which is additionally enlarged upon opening of the clamp, where the spring has to be compressed for the opening of the clamp. The force exerted by the compression spring, in case of an opened clamp, onto the clamping system is larger as compared to the case where the clamp is closed. Such a clamp is not considered to be advantageous since the clamp, so to speak, has to be opened against the spring. This means that the spring has to be further compressed for the opening of the clamp such that, in the following, the force exerted on the system by the compression spring is larger than in the case where the clamp is closed.

A construction which is very similar to this is illustrated in the European Patent EU-PS 56,919, which essentially distinguishes itself from the first recited reference construction only by the feature that the engagement point of the spring is disposed closer to the end of the lever arm comprising the roller. Thus, however, the mode of operation is not changed in principle and, again, this clamp has to be opened against the force of the spring, the spring has to be compressed further for opening of the clamp. Again, therefore, in the same way, the force exerted by the spring on the clamping system, in case of an open clamp, is larger as compared to the case where the clamp is closed even though, just in this case, a higher and more secure supported force would be required.

A construction which appears to be more advantageous relative to this particular aspect is illustrated and described in the Austrian Patent AT-PS 375,047. In this case, a spring packet, comprising cup springs, is pressed together for closing of the clamp and, upon opening or disengaging of the clamp, it is released, whereby the opening or the disengaging of the clamp is supported by a helical spring additionally provided. The cup spring packet is permeated by a guide rod, carrying on the ends the movable jaw, and acts onto the inner end of the spring packet on a sliding piece via a control cam, which control cam can be tilted based on a lever rigidly connected to the control cam. The sliding piece carries at its end a roller, which roller co-acts with the control cam. The very large forces have to be furnished in this case over relatively short level-like components, based on the direct and immediate action of the control cam onto the sliding piece supporting the spring packet, which results in a complicated construction and cannot be easily implemented and commanded.

Similar considerations also hold for clamps which can be coupled according to the U.S. Pat. No. 3,416,462, where two parallel switched helical springs, disposed inside of each other, are provided instead of a cup spring packet. The rod, permeating in this case the springs, acts with its outer front face onto a movable clamping jaw. The spring-loaded rod is itself actuated via a two-arm angle lever, where the outer end of the angle lever comprises rollers and is directed toward the clamping jaw, such that this level can perform only a limited motion relative to its angle, since no space for a larger area of motion is available in this region based on constructive limitations. Furthermore, large forces have to be transferred over short distances based on the relatively short level component.

Mention should also be made of the clamp according to the European Patent Application Laid Open EU-OS 150,701. This switchable clamp comprises a plurality of springs, where a part of the springs serves for testing of the clamping force. The movable clamping part is connected via several intermediately connected actuating members with a tiltably supported switching arm, which co-acts via its roller-containing end with a switching connecting link. The large number of the construction elements present in this case requires a large construction space, even though it is favorable in this construction, that the springs present in this construction, upon closing of the clamp, are pressed together and, on the contrary, are released upon opening of the clamp, such that the possibility exists with this construction to test the clamping force of the compression spring during operation.

The French Patent No. 1,537,191 to Jean Pomagalski teaches an improvement relative to devices which are suspended during a cable movement. The reference shows a clamping mechanism where clamps 14 and 15 hold at a cable 50.

SUMMARY OF THE INVENTION

1. Purposes of the Invention

It is an object of the invention to construct a clamp which can be coupled such that it has, in fact, a simple construction, requires only a small construction volume, and that the compression spring, furnishing the clamping force, is released upon opening of the clamp such that, following the requirement, the clamp capable of coupling can be formed without particular constructive additional expenditures such that its clamping force is testable during operation, without that thereby the clamping force increased, and where the clamping jaws are pressed together beyond their normal clamping operating position.

These and other objects and advantages of the present invention will become evident from the description which follows.

2. Brief Description of the Invention

The present invention provides for a clamp, capable of coupling, for clamping of transport means to a movable rope comprising a clamping body. A first clamping jaw is movable and formed as a first two-arm lever. One arm of the lever forms the clamping jaw. A second clamping jaw forms with the first clamping jaw a pair of clamping jaws for gripping a rope and attached to the clamping body. A compression spring presses the first clamping jaw to the rope. The second arm of the first lever is loaded by the compression spring. A tiltable lever is controlled by a spatially fixed connecting rail for allowing the compression spring to lift said first clamping jaw from the rope. An angle lever has an arm and is tiltably hinged at the free end of the first two-arm lever, including the movable first clamping jaw. The arm of the angle lever is hinged at the first two-arm level, while the clamp is in a closed state. The arm of the angle lever encloses with a middle axis of the clamping body an acute angle, such that the compression spring engages in the region of the vertex of the angle lever. Said compression spring is tiltably supported at the clamping body. The arm of the angle lever, cooperating with the connecting link, is directed away from the clamping jaws.

According to the present invention, an angle lever is tiltably hinged at the free end of the movable clamping jaw comprising a two-arm lever, where the arm of the angle lever is hinged at the first-mentioned two-arm lever during closed clamp and encloses during closed clamp with the axis of the clamping body an acute angle, and where the hinged arm of the angle lever engages the compression spring in the region of the vertex of the angle lever, which compression spring is tiltably supported at the clamping body and where the arm of the angle lever, cooperating with the connecting link, is directed away from the clamping jaws.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
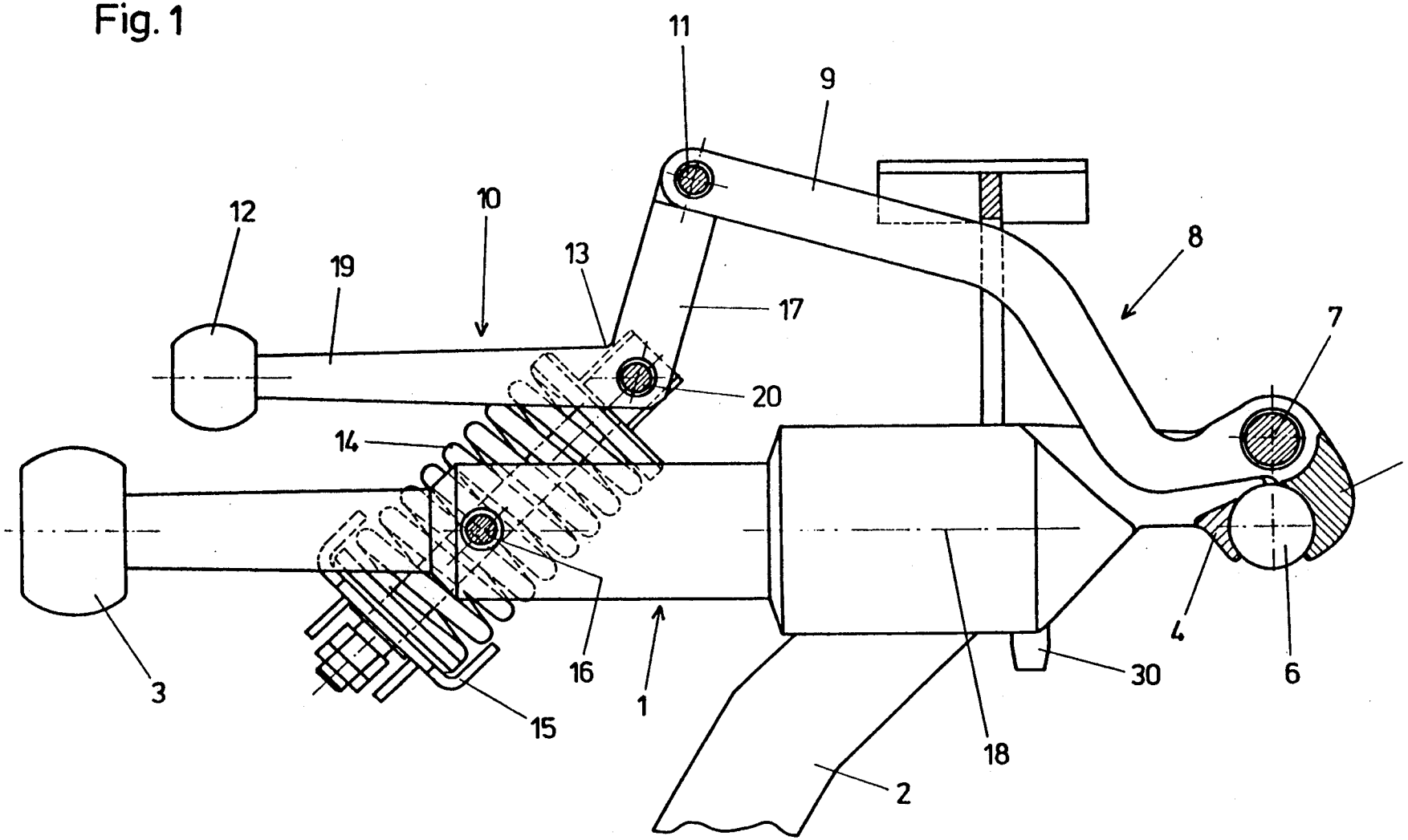
FIG. 1 shows schematically a side view of a first embodiment of a clamp in a closed position, partially as a sectional view.

In accordance with the present invention, there is provided a clamp capable of coupling, for clamping of transport means to a movable rope 6, in particular for a suspension attachment 2 of an aerial ropeway with at least one pair of clamping jaws 4, 5 gripping the rope 6. At least one clamping jaw 5 is pressed by a compression spring 14 to the rope 6 or, respectively, is liftable from this rope by a tiltable lever, controlled by a spatially fixed connecting link. The movable clamping jaw 5 is formed as a first two-arm lever 8. One arm of the lever 8 forms the clamping jaw 5 and the second arm 9 of the first lever 8 is loaded by a compression spring 14. An angle lever 10 is tiltably hinged at the free end of the first two-arm lever 8 including the movable clamping jaw 5. The arm 17 of the angle lever 10 is hinged at the first-mentioned lever 8 during closed clamp, and encloses with the axis 18 of the clamping body 1 an acute angle. An a result, the compression spring 14 engages in the region of the vertex 13 of the angle lever 10, which compression spring 14 is tiltably supported at the clamping body 1, and the arm 19 of the angle lever 10, cooperating with the connecting link, is directed away from the clamping jaws 4, 5.

The acute angle between the axis 18 of the clamping body 1 and the one arm 17 of the angle lever 10 can be open toward the clamping jaws 4, 5.

The arm 19 of the angle lever 10, co-acting with the connecting link, can be longer than that arm, which is connected with the first two-arm lever 8 including the movable clamping jaw 5.

The swivelling axis 7 of the first two-arm lever 8, the vertex 13 of the angle lever 10, and the swivelling axis 11 between these two levers 8, 10, can be disposed approximately on an imaginary straight line, while the clamp is open.

The swivelling axis 11 between the two levers 8, 10 can be disposed, during open clamp, between the clamping body 1 and the imaginary straight line connecting the swivelling axis 7 of the two-arm lever 8 and the vertex 13 of the angle lever 10.

The engagement point 20 of the compression spring 14, provided in the vertex 13 of the angle lever 10, can be disposed, relative to an imaginary straight line connecting the swivelling axis 11 and the axis 16 of the compression spring 14, on the sides of the clamping body 1, that is, on the sides of the clamping jaws 4, 5, while the clamp is closed. In case the clamp is open, the engagement point 20, provided in the vertex 13 of the angle lever 10, can be disposed on the side remote from the clamping jaws 4, 5 relative to an imaginary straight line connecting the swivelling axis 11 and the axis 16 of the compression spring 14.

The second clamping jaw 4 can be adjustably positioned relative to the clamping body 1. Said clamping jaw 4 can be connected with a guide rod 21 received by the clamping body 1. A spring 22, disposed in the clamping body 1, which spring 22 is preferably a cup spring packet, can be axially permeated. Said spring 22 can be supported, on the one hand, at the inner part of the clamping body 1 and, on the other hand, at a collar 23 of the guide rod 21 neighboring to the clamping jaw 4.

An actuating bolt 27 can be provided tiltably supported in the clamping body 1 and protruding outwardly. Said actuating bolt 27 can be placed in an actuating connection with the guide rod 21 of the one clamping jaw 4. The actuating bolt 27 can protrude in particular in a recess 28 provided in the guide rod 21. The actuating pin 27 can be tilted by a shifting of the guide rod 21 against the clamping body 1.

Figure 2:
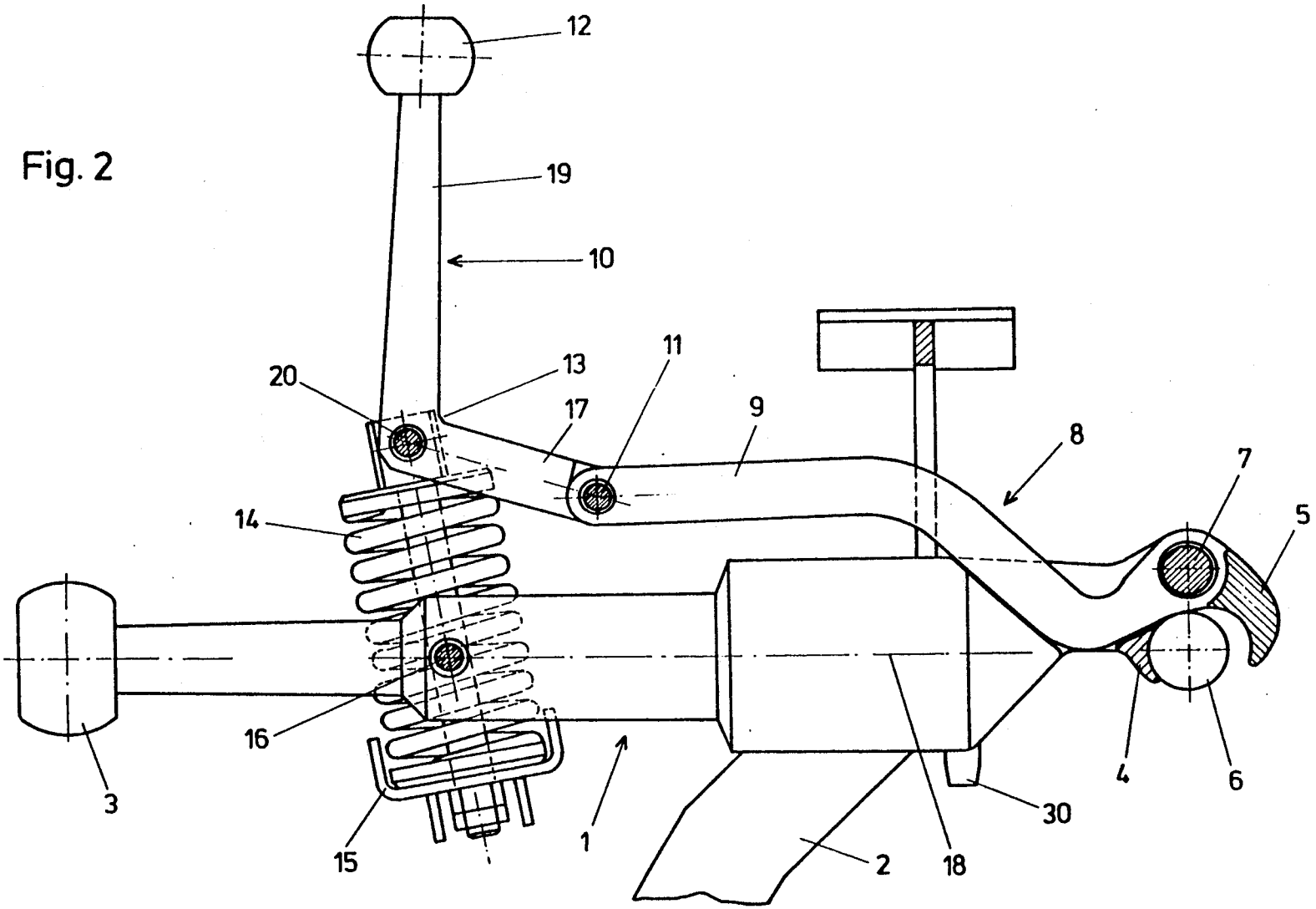
FIG. 2 shows schematically a side view of a first embodiment of a clamp in an open position, partially as a sectional view.

The clamp according to FIGS. 1 and 2 comprises a long extended clamping body 1. A hanger or a suspension attachment 2, not illustrated in detail here, is swingingly hinged to the clamping body 1. A roller 3, supported freely rotatable at the ends, serves for guiding the clamp in the station region. The clamping jaws 4 and 5, which are to grip clampingly the moving rope 6, are disposed at the other end of the clamping body. The clamping jaws 4 are supported spatially fixed against the clamping body 1 according to this embodiment. In contrast, the clamping jaw 5 is tiltable within the drawing plane and, in fact, tiltable around the swivelling axis 7. This clamping jaw 5 forms an arm of a two-arm lever 8, tiltable around the mentioned axis 7. An angle lever 10 is hinged, in fact, at the free end of the second arm 9 of the tiltable lever 8. The two levers 8 and 10 are movable against each other around the swivelling axis 11 and, in fact, in this case within the plane of the drawing. The angle lever 10 carries at its outer end also a freely rotatable roller 12. The roller 12 cooperates with a spatially fixed connecting link, which is not illustrated here, which serves in a station of a rope-way plant and serves for actuating of the clamp.

The compression spring 14, formed as a helical spring, engages in the region of the vertex 13 of this angle lever 10. The compression spring 14 is provided for the purpose of furnishing the required clamping pressure. Since the compression spring 14 has to cover only a small travel stroke or spring extension in the construction of this invention device, the compression spring 14 can be guided in that, for example, guide bars are furnished on its inner side, which guide bars are disposed close to the inner side of the thread turns. This compression spring 14 is supported at a spring saddle 15 with its other end. The spring saddle 15 is tiltably supported around the axis 16. This axis 16 is disposed perpendicular relative to the drawing plane and forms part of the clamping body 1.

The arm 17 of the angle lever 10, which is hinged at the two-arm lever 8 via the swivelling axis 11, encloses, during closed clamp with the axis 18 of the clamping body 1, an acute angle, as can be seen from FIG. 1. This acute angle is, in a practical situation, less than 90 degrees and larger than 60 degrees, and preferably between 70 and 80 degrees. The compression spring 14 engages further the angle lever 10 in the area of the vertex 13. The arm 19 of the angle lever 10, cooperating with the control connecting link, not illustrated, is directed away from the clamping jaws 4, 5. The arrangement is furnished further in such a way that the recited acute angle between the axis 18 of the clamping body 1 and the arm 17 of the angle lever 10 is open toward the clamping jaws.

The arm 19 of the angle lever 10, cooperating with the connecting link, not illustrated, is longer than that arm 17, which is hinged to the two-arm lever 8. The compression spring 14 is provided in a practical embodiment of the clamp in general in pairs, where in each case one compression spring is disposed at the two sides of the clamping body 1.

It can be further recognized from FIGS. 1 and 2 that, in case of an open clamp, the swivelling axis 7 of the two-arm lever 8, the vertex 13 of the angle lever 10, and the swivelling axis 11, are disposed approximately on an imaginary straight line between these two levers 8 and 10. In particular, the swivelling axis 11 between the two levers 8 and 10, while the clamp is open, is disposed between the clamping body 1 and an imaginary straight line connecting the swivelling axis 7 of the two-arm lever 8 and the vertex 13 of the angle lever 10.

It can further be recognized from FIGS. 1 and 2 that, in case of a closed clamp, the engagement point 20 of the compression spring 14, provided in the vertex 13 of the angle lever 10, is disposed relative to an imaginary straight line connecting the swivelling axis 11 and the axis 16 of the compression spring 14 on the sides of the clamping body 1, that is on the sides of the clamping jaws 4, 5. Furthermore, in case of an open clamp, the engagement point 20 of the compression spring 14, provided in the vertex 13 of the angle lever 10, is disposed on the side remote to the clamping jaws 4, 5 relative to an imaginary straight line connecting the swivelling axis 11 and the axis 16 of the compression spring 14.

The aforegoing has referred to the constructive setup of the clamp. If the clamp is opened, based on the cooperation of the not illustrated control connection element and the angle lever 10, then the angle lever 10 is tilted upwardly in a clockwise direction, compare FIG. 2. The swivelling axis 11 migrates in this case toward the clamping body 1. In contrast, the engagement point 20 of the compression spring 14 is tilted upwardly in the region of the vertex 13 of the angle lever 10. The engagement point 20 of the compression spring 14 passes, during the initiation of this motion, initially a dead point, whereupon however the distance between the spring end piece or spring saddle 15 and the engagement point 20 of the spring 14 increases such that the compression spring 14 becomes released. In this case, the larger part of the path of the clamping jaw 5 can be covered without an action of the spring, only bearing frictional forces have to be overcome during the larger part of the path. Based on the described construction, the angle lever 10 can pass over a large travel stroke and the compression spring 14 is released upon opening of the clamp. The large travel stroke of the angle lever 10 allows a large opening of the mouth of the clamp without that the spring becomes loaded. Based on the lever leverage and the geometry of the axis relative to each other, large clamping forces can be achieved with small actuating forces. In order to test the clamping force or, respectively, the force of the tensioned spring during closed clamp, the angle lever 10 is slightly lifted up and, in fact, by such an amount which is smaller than is required for the overcoming of the dead point. In this case, the clamping jaws 4 and 5 are additionally somewhat clamped together.

Figure 3:
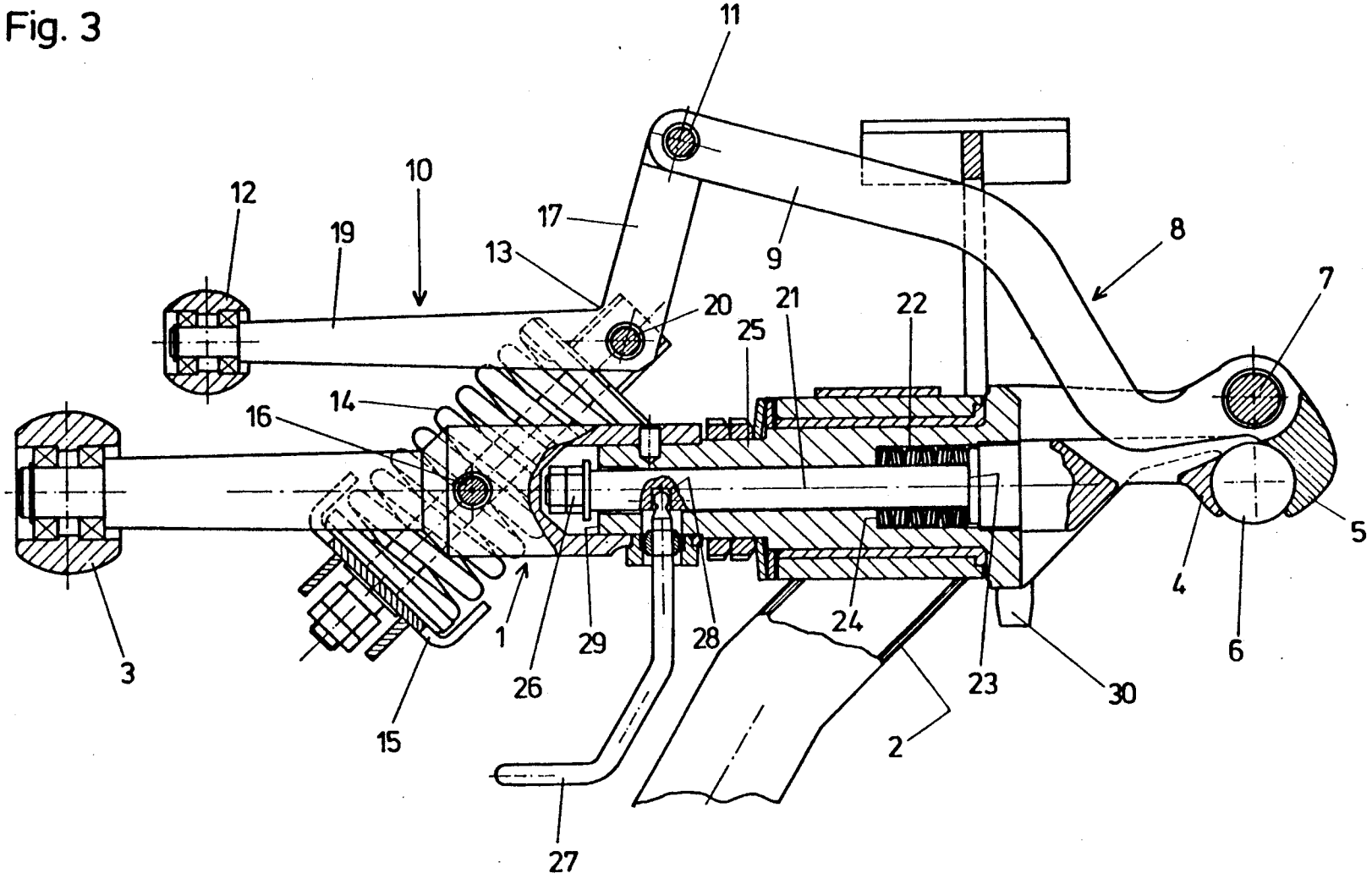
FIG. 3 shows schematically a side view of a second embodiment of a clamp in a closed position, partially as a sectional view.
Figure 4:
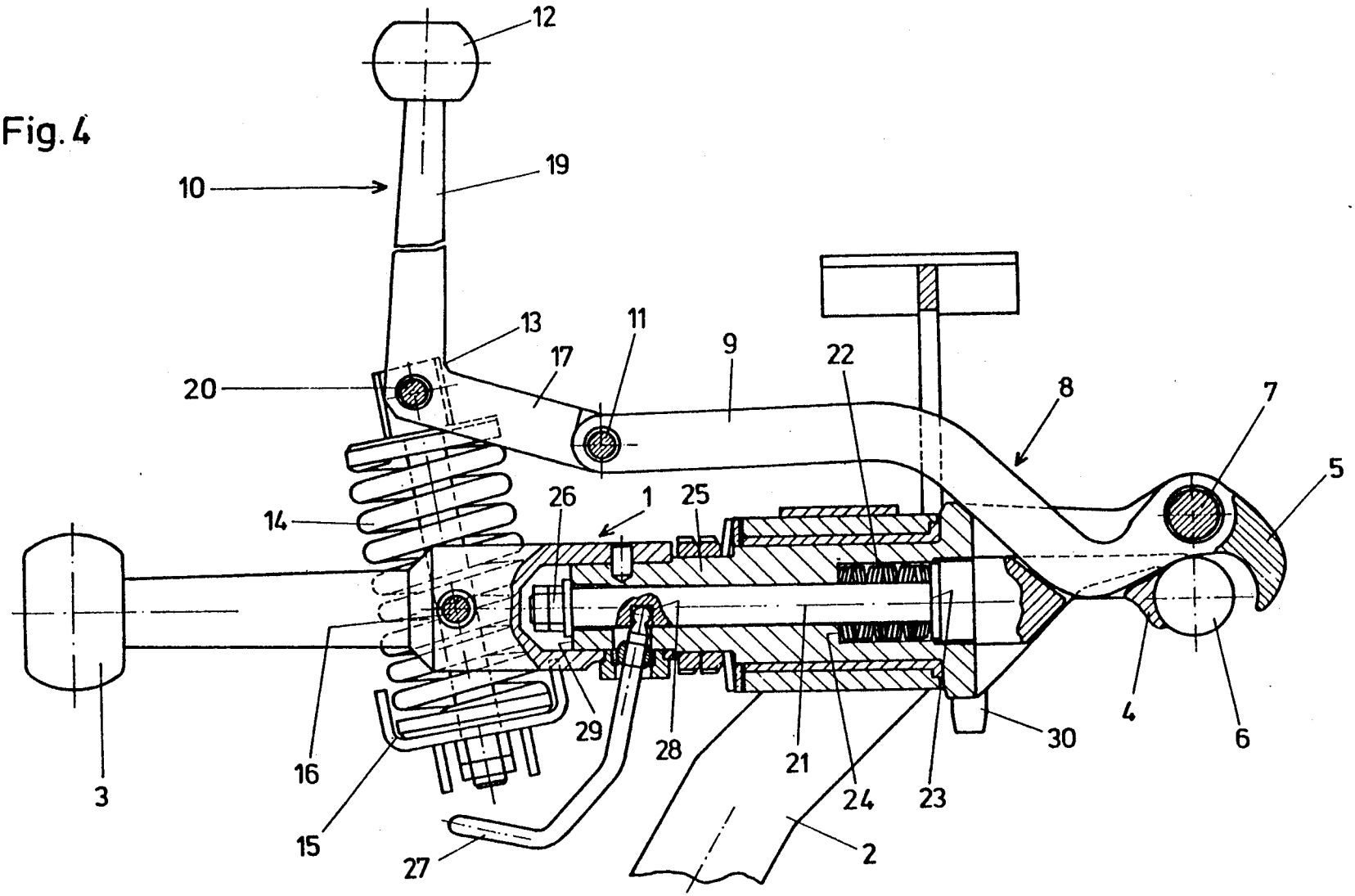
FIG. 4 shows schematically a side view of a second embodiment of a clamp in an open position, partially as a sectional view.

Based on the simple construction of this clamp, it is possible to position also the second clamping jaw 4 adjustable relative to the clamping body 1, as illustrated in FIGS. 3 and 4. For this purpose, this second clamping jaw 4 is received by the clamping body 1 and is solidly connected to the guide rod 21 disposed with a parallel axis relative to the clamping body 1. This guide rod 21 permeates within the clamping body 1 a spring packet 22, formed by Belleville spring washers or cup springs, which spring packet 22 is supported on the one hand at a collar 23 of the guide rod 21 neighboring the clamping jaws 4 and, on the other hand, at the inner shoulder 24 of the clamping body 1 formed from several parts in this case. This guide rod 21 is guided in a bush 25 over the larger part of its length. The bush 25 is spatially fixedly disposed within the clamping body 1. The inner part of the guide rod 21 protrudes beyond the front end 29 of the guide bush 25 and carries, at this point, a stop 26 formed of screwed-on nuts.

An actuating bolt 27 is tiltably supported in the lower part of the clamping body 1 and in the region of the clamping body 1 covered by the bush 25. The actuating bolt 27 protrudes with its inner end into a recess 28 of the guide rod 21 of the clamping jaw 4.

The construction of the outer lever structure, which comprises the two-arm lever 8 with the clamping jaw 5 and the angle lever 10 and also the compression spring 14, corresponds in identical fashion to the first embodiment illustrated in FIGS. 1 and 2. Based on the additional construction of the clamp (FIGS. 3 and 4), it becomes possible to test the action of the compression spring 14 during operation without that the clamping jaws 4 and 5 are pressed together any further as would correspond to its regular operating position. If the compression spring 14 is functioning and if the compression spring 14 exerts the force intended for it during a closed clamp, as illustrated in FIG. 3, then the actuating bolt 27 assumes the position illustrated in FIG. 3. However, if the compression spring 14 is damaged for any reason whatsoever, such that the full clamping force cannot be furnished, then the inner spring packet 22 of the clamping jaw 4 shifts forward slightly versus the clamping body 1, as illustrated in FIG. 4 to the right side, up to that the clamping forces prevailing at the rope are again put into balance, or that the stop 26 rests at the front face 29 of the bush 25, whereby the actuating bolt 27, however, is placed into an inclined position. Switching members are arranged within the station of the ropeway plant in the region to be covered by the inclined positioned actuating bolt 27. The switching members are actuated by the inclined positioned actuating bolt 27 and subsequently release switching processes, which influence the operation of the plant and which, in particular, discontinue operation of the plant and/or furnish alarm signals.

If the construction principle of the clamp illustrated in FIGS. 3 and 4 is considered schematically, then it can be noted that the rope is clamped from both sides by two spring-loaded jaws 4 and 5 in case of a closed and properly operating and functioning clamp. The rope assumes, relative to the proper clamping body 1, a balanced position corresponding to the two forces. If one of the springs is damaged such that the spring force, intended to be provided by that spring, cannot be fully furnished any longer, then the rope is moved, in its position relative to the clamping body 1, until there is reached again a balanced position between the two spring-loaded clamping jaws. The rope can, from its intended set-point position in this construction depending on which of the springs has become damaged, escape into two opposite directions, where the escape direction is signalled via the actuating bolt. In case of a corresponding construction of the outer, spatially fixed and station-bound switching devices, which are actuated by the actuating bolt 27 of a deviating position of the actuating bolt 27, then it can be determined immediately what the cause is for the switch actuation, such as a damaged outer or a damaged inner spring. Not only the freely rotatable roller 3 serves for an exact guiding of the switchable clamp in the station region, but, in addition, the running rollers 30 provided at the two sides of the clamping body 1. Such running rollers 30 rest, relative to the illustration of FIGS. 1 to 4, both in front of the drawing plane as well as behind the drawing plane. For this reason, only a small edge section of these running rollers 30 is visible in the illustrations furnished in FIGS. 1 to 4.

The operation of the present invention occurs by clamping the rope 6 with the clamping jaws 4 and 5, illustrated in FIG. 1. The clamp thus runs together with the rope 6. The connecting link can be a spatially fixed connecting link which is provided by, for example, a metal piece located in a station building of a rope lift. The linking member can be a spatially fixed rail, which protrudes into the course of the roller 12 of the angle lever 10 and which is disposed at an inclined angle versus the course of the motion. If the rope clamp runs together with the rope 6 into that region of the station where the clamp is to be opened, then the roller 12 runs along this rail linking member, and the lever 10 is pressed upward, based on the inclined position of the rail linking member versus the running course of the rope 6. Such a rail is indicated in FIG. 5 in the dash-dotted square line surrounding the roller 12.

Figures 5, 6, 7, 8, 9:
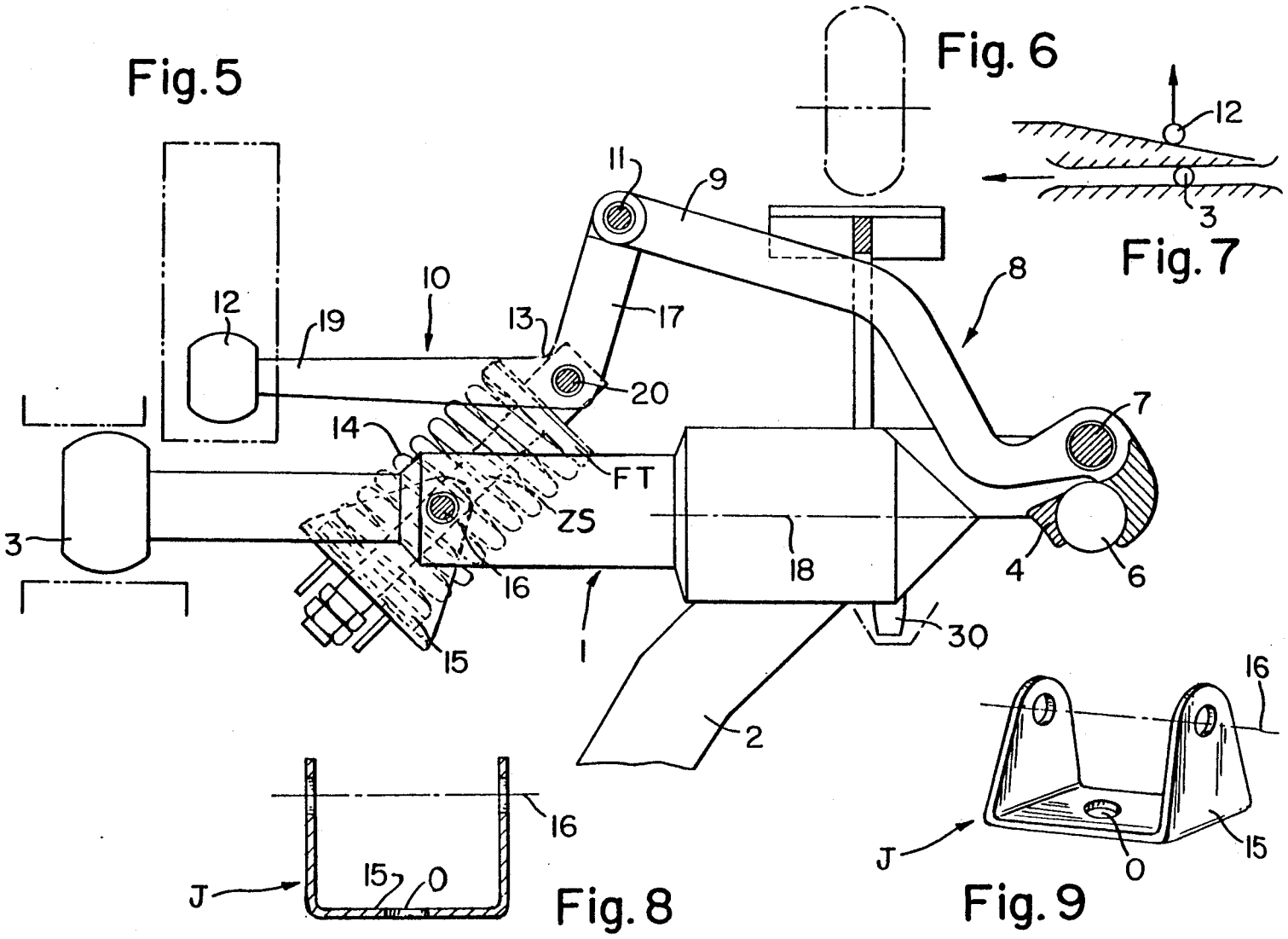
FIG. 5 is a modified view of FIG. 1 indicating further the presence of a rail.
FIG. 6 is a sketch of the interaction of roller and rail.
FIG. 7 is a sectional view illustrating the operating or actuating forces between the levers.
FIG. 8 is a sectional view of a spring saddle
FIG. 9 is a perspective view of a spring saddle
Figure 10:
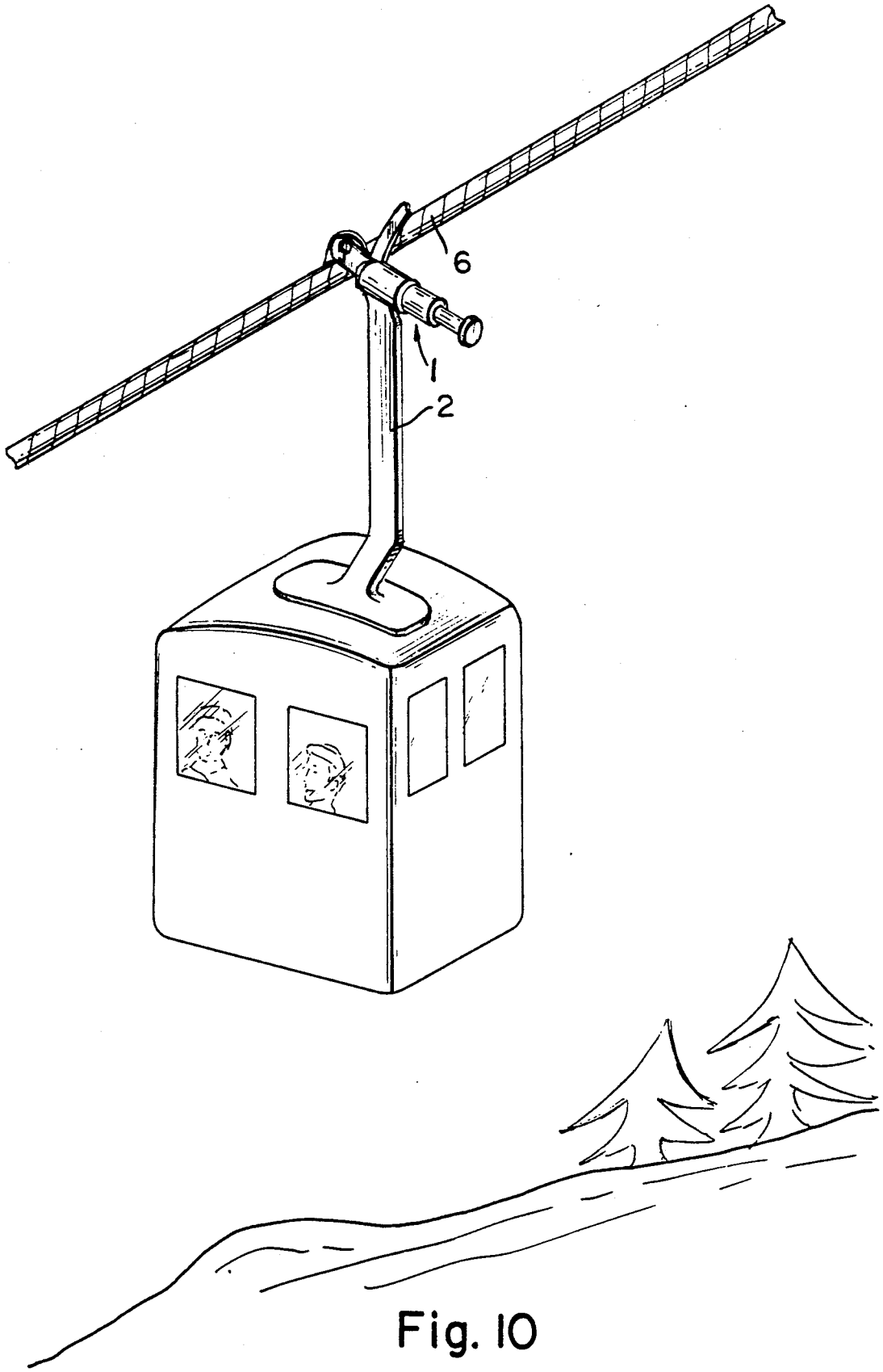
FIG. 10 is a schematic illustration of the operation of the clamp construction.

As to the operation of the compression spring 14, it is noted that the spring cup FT in FIG. 5 is hinged at the point 20 with a cylindrical guide shaft ZS. A U-shaped yoke J is tiltably disposed with a center opening O through which the shaft ZS is freely passing. The spring 14, which is penetrated by this shaft ZS, is itself supported on the one hand at the spring cup FT and, on the other hand, at the center region of the yoke J (15).

In the region of the stations, there are provided linking members or guide rails, which are spatially fixed and at which the rollers 3 or, respectively, 30 roll off, in order to position or, respectively, guide the clamp within the station in a predetermined location. These guides have to assume a precisely predetermined position within the system and within the station where the clamp is open or closed, respectively, in order to perform switching operations reliably and safely. Consequently, such guides are disposed within the station region. Furthermore, the part which is disposed behind the lever 8 runs along a roller in the region of the station where the clamp is opened or closed. In order to lift the angle lever 10 or, respectively, to press the angle lever back, there is provided a further linking member or guide rail, which is disposed at an angle relative to the guide planes of the rails. In order to be able to tilt the lever 10, there is necessary an operating force. Based on the construction of the levers and the translation ratios of the levers, these actuating forces are small. The actuating forces are provided in that the driven rope 6 pulls the clamp through these guides and rails. Such a construction is illustrated in FIG. 7. The roller 3 at the clamping body 1 runs through a straight guide, which is disposed within the plane of the circulating rope 6. The arrow on the left side of FIG. 7 indicates the pulling direction and the course direction of the rope 6. The switching rail for the roller 12 runs at an angle thereto. The roller 12 is pulled along and, based on the inclined position of this switching rail, escapes in an upward direction, and the force necessary for this is small based on this construction. A further linking member or guide rail is provided, which effects this tilting motion of the lever for closing of the clamp, that is, for moving the lever 10 counter-clockwise.

The suspension attachment 2 is provided by a rod, which furnishes a connection between the clamp and that device element, which has to receive the loads to be carried such as, for example, the cabin of a rope lift.

Referring now to the bush 25 in detail, it is noted that the parts 1 and 25 of the embodiment of FIGS. 3 and 4 are solidly connected to each other and thus form a uniform construction part. The part 25 is provided with a center bore, parallel to the axis, and the guide rod 21 is slidably supported in said bore. The guide rod 21 carries at its one end the clamping jaw 4. If the clamp is closed, as illustrated in FIG. 3, then the jaw 4 and thus the guide rod 21 is shifted somewhat to the left against the force of the spring 22. If the clamp is open, then the spring 22 shifts the guide rod somewhat toward the right, until the screw 26 rests at the inner front face 29 of the part 25, as illustrated in FIG. 4.

If the spring 14 is operating and functioning, then the clamping jaw 4 is pressed slightly toward the left, as illustrated in FIG. 3, in case of a closed clamp, via the clamping jaw 5 and the rope 6. Thereby the guide rod 21 is shifted slightly to the left. The movability of this guide rod 21 serves for tilting the switching bolt 27. If the spring 14 would not be operating and would provide only part of the required clamping force, then, in case of a closed clamp, the clamping jaw 4 would not be shifted so far to the left as this would be the case with a properly functioning spring 14. This would have the consequence that now the lever 27 is disposed somewhat inclined. Tiltable levers are disposed in the region of the inclined disposed bolt 27 in the rope-lift station, which actuate switches and which interrupt operation of the lift, if the clamping force is not sufficiently high, which clamping force retains the clamp in a closed state. If the clamp is closed and the clamping force is sufficiently high, then the switching bolt 27 passes the lever and cannot actuate it. However, if the clamping force is insufficiently large, based on a damage to the spring 14, then this lever is disposed at an angle and actuates the corresponding switching pin.

The right part of the bush 25 forms a bearing bolt for the suspension attachment 2. In order to avoid that the suspension attachment starts to swing freely perpendicularly to the plane of the drawing, based on operational rope motions, there is provided a cup spring at the left side of the bearing eye of this suspension attachment, where the pretension of the cup spring can be adjusted with a nut and a counter-nut. These two nuts are screwed onto the thread.

If the suspension attachment is disposed in a so-called dead-point position and cannot fall back in its starting position, then the lever 10, in FIG. 2, is pressed toward the left in order to close the clamp, and thereby the spring 14 tilts initially around the axis 16 slightly toward the left and only then into the position illustrated in FIG. 1. If the axes 20, 11, and 7 are disposed in a straight line, with the clamp open, or if the swivelling axis 11 is disposed above the line, connecting the elements 20 and 7, with the clamp open, then the desired dead-position of the suspension attachment is not sufficiently secured. In order to open the clamp, the lever 8, and thus the swivelling axis or hinge point 11, is moved downwardly in a counter-clockwise direction, as illustrated in FIG. 2, and the clamp is opened thereby.

An angle from about 110 to 130 degrees can be provided between the arms 19 and 17 of the angle lever 10. The arm 9 of the movable clamp can have a slight S-shape in order to provide for a certain resiliency. The direction of the arm 9 of the movable clamp can form an angle between the swivelling axes 7 and 11 of from 120 to 140 degrees relative to a plane passing through the swivelling axis 7 and through the center of the rope 6. The thickness of the arm 9 can be from about 0.5 to 2 times the diameter of a rope to be gripped. In the state where the rope is being gripped, the connection line between the swivelling axis 7 and 11 can form an angle of from about 70 to 85 degrees with the arm 17 running from the swivelling axis 11 to the attachment point 20.

It will be understood that each of the elements described above, or two or more together, may also find a useful application in other types of linkable clamping devices differing from the types described above.

While the invention has been illustrated and described as embodied in the context of a linkable clamping device for the coupling of transport means to a mobile cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamp capable of coupling for clamping of transport means to a movable rope comprising a clamping body;

a first clamping jaw, where the first clamping jaw is movable and formed as a first two-arm lever and having a first arm for a jaw and having a second arm;

a second clamping jaw forming with the first clamping jaw a pair of clamping jaws for gripping a rope and attached to the clamping body;

a compression spring for pressing the first clamping jaw to the rope, and where the second arm of the first lever is loaded by the compression spring and wherein the compression spring is essentially released when the pair of clamps are closed and where the spring is compressed when the pair of clamps are closed;

a tiltable angle lever to be controlled by a spatially fixed connecting rail for allowing the compression spring to lift said first clamping jaw from the rope; said tiltable angle lever having a first arm and tiltably hinged at the other end of the first two-arm lever, where the first arm of said tiltable angle lever is hinged at the first two-arm lever, and where, while the clamp is closed, the first arm of said tiltable angle lever encloses with a middle axis of the clamping body an acute angle, such that the compression spring engages in the region of the vertex of said tiltable angle lever, which compression spring is tiltably supported at the clamping body, and wherein a second arm of said tiltable angle lever, cooperating with the connecting rail, is directed away from the clamping jaws.

2. The clamp capable of coupling according to claim 1, wherein the acute angle between the middle axis of the clamping body and the first arm of the tiltable angle lever is open toward the clamping jaws while the clamp is in the closed position.

3. The clamp capable of coupling according to claim 1, wherein the second arm of the tiltable angle lever, co-acting with the connecting rail, is longer than that arm, which is connected with the first two-arm lever, including the movable clamping jaw.

4. The clamp capable of coupling according to claim 1, wherein a swivelling axis of the first two-arm lever, the vertex of the tiltable angle lever, and the swivelling axis between the first two arm lever and the tiltable angle lever are disposed nearly on an imaginary straight line, while the clamp is open.

5. The clamp capable of coupling according to claim 1, wherein, in case of a closed clamp, an engagement point of the compression spring, provided in the vertex of the tiltable angle lever, is disposed, relative to an imaginary straight line connecting the axis between the first two arm lever and the tiltable angle lever and the axis of the compression spring, on the side of the clamping jaws, and wherein, in case of an open clamp, the engagement point, provided in the vertex of the tiltable angle lever, is disposed in the side remote from the clamping jaws, relative to an imaginary straight line connecting the swivelling axis and the axis of the compression spring such that the compression spring is compressed while the clamp is in a closed position.

6. The clamp capable of coupling according to claim 1,, wherein the second clamping jaw is adjustably positioned relative to the clamping body, and where this clamping jaw is connected with a guide rod received by the clamping body, and further comprising a spring disposed in the clamping body, which spring is preferably a cup spring packet, and where the spring is axially permeated and is supported, on the one hand, at the inner part of the clamping body and, on the other hand, at a collar of the guide rod neighboring to the clamping jaw.

7. The clamp capable of coupling according to claim 6, wherein an actuating pin is provided tiltably supported in the clamping body and protruding outwardly, which actuating pin is placed in an actuating connection with the guide rod of the second clamping jaw, and where the actuating pin protrudes in particular in a recess provided in the guide rod, and where the actuating pin can be tilted versus the clamping body by a shifting of the guide rod.

8. Clamp capable of coupling for clamping of transport means to a movable rope (6), in particular for a suspension attachment (2) of an aerial ropeway with at least one pair of clamping jaws (4, 5) gripping the rope (6), where at least one clamping jaw (5) is pressed by a compression spring (14) to the rope (6) or, respectively, is liftable from this rope by a tiltable lever, controlled by a spatially fixed connecting rail, and where the movable clamping jaw (5) is formed as a first two-arm lever (8), where one arm of the first two-arm lever (8) forms the clamping jaw (5), and where the second arm (9) of the first two-arm lever (8) is loaded by a compression spring (14), where an angle lever (10) is tiltably hinged at the other end of the first two-arm lever (8), where a first arm (17) of the angle lever (10) is hinged at the first-mentioned two-arm lever (8) and where the first arm (17), during closed clamp, encloses with the axis (18) directed toward the rope of the clamping body (1) an acute angle, such that the compression spring (14) engages in the region of the vertex (13) of the angle lever (10), which compression spring (14) is tiltably supported at the clamping body (1), wherein the spring is essentially released when the clamp is opened, wherein the spring is compressed when the clamp is closed, and wherein a second arm (19) of the angle lever (10), cooperating with the connecting rail, is directed away from the clamping jaws (4, 5).

9. The clamp capable of coupling according to claim 8, wherein the acute angle between the axis (18) of the clamping body (1) and the first arm (17) of the angle lever (10) is open toward the clamping jaws (4, 5) while the clamp is in the closed position.

10. The clamp capable of coupling according to claim 8, wherein the second arm (19) of the angle lever (10), co-acting with the connecting rail, is longer than that arm, which is connected with the first two-arm lever (8) including the movable clamping jaw (5).

11. The clamp capable of coupling according to claim 8, wherein a swivelling axis (7) of the first two-arm lever (8), the vertex (13) of the angle lever (10), and the hinge (11) between these two levers (8, 10), are disposed nearly on an imaginary straight line, while the clamp is open.

12. Clamp capable of coupling according to claim 11, wherein the swivelling axis (11) between the first two-arm lever (8) and the angle lever (10) is disposed, during open clamp, between the clamping body (1) and the imaginary straight line connecting the swivelling axis (7) of the first two-arm lever (8) and the vertex (13) of the angle lever (10).

13. Clamp capable of coupling according to claim 8, wherein, in case of a closed clamp the engagement point (20) of the compression spring (14), provided in the vertex (13) of the angle lever (10), is disposed, relative to an imaginary straight line connecting the axis between the first two arm lever and the tiltable angle lever and the axis of the compression spring, on the side of the clamping jaws (4, 5), and wherein, in case the clamp is open, the engagement point (20), provided in the vertex (13) of the angle lever (10), is disposed on the side remote from the clamping jaws (4, 5) relative to an imaginary straight line connecting the swivelling axis (11) and the axis (16) of the compression spring (14) such that the compression spring (14) is in a compressed state while the clamp is in an activated state.

14. Clamp capable of coupling according to claim 8, wherein the second clamping jaw (4) is adjustably positioned relative to the clamping body (1), and wherein this clamping jaw (4) is connected with a guide rod (21) received by the clamping body (1), where a spring (22), disposed in the clamping body (1), is axially permeated, and where the spring is supported, on the one hand, at the inner part of the clamping body (1) and, on the other hand, at a collar (23) of the guide rod (21) neighboring to the clamping jaw (4), and wherein the spring (22) can be formed as a cup spring packet.

15. Clamp capable of coupling according to claim 14, wherein an actuating pin (27) is provided tiltably supported in the clamping body (1) and protruding outwardly, which actuating pin (27) is placed in an actuating connection with the guide rod (21) of the second clamping jaw (4), and where the actuating pin (27) protrudes in particular in a recess (28) provided in the guide rod (21), and where the actuating pin (27) can be tilted versus the clamping body (1) by a shifting of the guide rod (21).

16. Clamp capable of coupling for clamping of transport means to a movable rope (6), in particular for a suspension attachment (2) of an aerial ropeway with at least one pair of clamping jaws (4, 5) gripping the rope (6), where at least one clamping jaw (5) is pressed by a compression spring (14) to the rope (6) or, respectively, is liftable from this rope by a tiltable lever, controlled by a spatially fixed connecting rail, and where the movable clamping jaw (5) is formed as a first two-arm lever (8), where one arm of the first two-arm lever (8) forms the clamping jaw (5), and where the second arm (9) of the first two-arm lever (8) is loaded by a compression spring (14), where an angle lever (10) is tiltably hinged at the other end of the first two-arm lever (8), where a first arm (17) of the angle lever (10) is hinged at the first two-arm lever (8), and where the first arm (17), during closed clamp, encloses with the axis (18) of the clamping body (1) an acute angle, such that compression spring (14) engages in the region of the vertex (13) of the angle lever (10) such that the clamp is closed when the compression spring is compressed and such that the clamp is opened when the spring is in a substantially unloaded state, which compression spring (14) is tiltably supported at the clamping body (1), and wherein a second arm (19) of the angle lever (10), cooperating with the connecting rail, is directed away from the clamping jaws (4, 5); wherein the acute angle between the axis (18) of the clamping body (1) and the first arm (17) of the angle lever (10) is open toward the clamping jaws (4, 5);

wherein the second arm (19) of the angle lever (10), coacting with the connecting rail, is longer than that arm, which is connected with the first two-arm lever (8) (5).

* * * * *